US009181753B2

(12) United States Patent
Puccio et al.

(10) Patent No.: US 9,181,753 B2
(45) Date of Patent: Nov. 10, 2015

(54) OFFSHORE WELL DRILLING SYSTEM WITH NESTED DRILLING RISERS

(71) Applicant: Cameron International Corporation, Houston, TX (US)

(72) Inventors: William Puccio, Houston, TX (US); David Cain, Houston, TX (US); Vijay A. Cheruvu, Houston, TX (US); Shian Jiun Chou, Houston, TX (US)

(73) Assignee: Cameron International Corporation, Houston, TX (US)

( * ) Notice: Subject to any disclaimer, the term of this patent is extended or adjusted under 35 U.S.C. 154(b) by 204 days.

(21) Appl. No.: 13/719,468

(22) Filed: Dec. 19, 2012

(65) Prior Publication Data

US 2013/0153240 A1 Jun. 20, 2013

Related U.S. Application Data

(60) Provisional application No. 61/577,436, filed on Dec. 19, 2011.

(51) Int. Cl.

| | |
|---|---|
| ***E21B 7/12*** | (2006.01) |
| ***E21B 17/01*** | (2006.01) |
| ***E21B 19/00*** | (2006.01) |

(52) U.S. Cl.

CPC ..... *E21B 7/12* (2013.01); *E21B 17/012* (2013.01); *E21B 19/004* (2013.01)

(58) Field of Classification Search

CPC ..... E21B 19/004; E21B 19/006

See application file for complete search history.

(56) References Cited

U.S. PATENT DOCUMENTS

| | | | | |
|---|---|---|---|---|
| 3,999,617 | A * | 12/1976 | Ilfrey et al. | 175/7 |
| 4,059,148 | A * | 11/1977 | Blomsma | 166/359 |
| 4,099,560 | A * | 7/1978 | Fischer et al. | 166/350 |
| 4,185,694 | A | 1/1980 | Horton | |
| 4,819,730 | A | 4/1989 | Williford et al. | |
| 5,533,574 | A * | 7/1996 | Gonzalez | 166/358 |
| 6,273,193 | B1 * | 8/2001 | Hermann et al. | 166/359 |
| 6,913,092 | B2 * | 7/2005 | Bourgoyne et al. | 175/7 |
| 7,188,677 | B2 * | 3/2007 | Moe | 166/355 |
| 7,866,399 | B2 | 1/2011 | Kozicz et al. | |
| 2004/0240947 | A1 | 12/2004 | Wetch | |

OTHER PUBLICATIONS

PCT International Search Report and Written Opinion dated Apr. 8, 2013 for related PCT Application No. PCT/US2012/070602 filed Dec. 19, 2012.

* cited by examiner

*Primary Examiner* — Matthew Buck
*Assistant Examiner* — Douglas S Wood
(74) *Attorney, Agent, or Firm* — Chamberlain Hrdlicka

(57) ABSTRACT

An offshore well drilling system for drilling a subsea well, including a floating platform, an external riser extending from the subsea well, and an internal riser extending from the subsea well to the platform. The internal riser is nested within the external riser. The system also includes an external riser tension device to apply tension to the external riser. The system also includes an internal riser tension device, separate from the external riser tension device, to apply tension to the internal riser.

21 Claims, 2 Drawing Sheets

OFFSHORE WELL DRILLING SYSTEM WITH NESTED DRILLING RISERS

BACKGROUND

Drilling offshore oil and gas wells includes the use of offshore platforms for the exploitation of undersea petroleum and natural gas deposits. In deep water applications, floating platforms (such as spars, tension leg platforms, extended draft platforms, and semi-submersible platforms) are typically used. One type of offshore platform, a tension leg platform ("TLP"), is a vertically moored floating structure used for offshore oil and gas production. The TLP is permanently moored by groups of tethers, called a tension leg, that eliminate virtually all vertical motion of the TLP. Another type of platform is a spar, which typically consists of a large-diameter, single vertical cylinder extending into the water and supporting a deck. Spars are moored to the seabed like TLPs, but whereas a TLP has vertical tension tethers, a spar has more conventional mooring lines.

The offshore platforms typically support risers that extend from one or more wellheads or structures on the seabed to the platform on the sea surface. The risers connect the subsea well with the platform to protect the fluid integrity of the well and to provide a fluid conduit to and from the wellbore.

The risers that connect the surface wellhead to the subsea wellhead can be thousands of feet long and extremely heavy. To prevent the risers from buckling under their own weight or placing too much stress on the subsea wellhead, upward tension is applied, or the riser is lifted, to relieve a portion of the weight of the riser. Since offshore platforms are subject to motion due to wind, waves, and currents, the risers must be tensioned so as to permit the platform to move relative to the risers. Accordingly, the tensioning mechanism must exert a substantially continuous tension force to the riser within a well-defined range.

An example method of tensioning a riser includes using buoyancy devices to independently support a riser, which allows the platform to move up and down relative to the riser. This isolates the riser from the heave motion of the platform and eliminates any increased riser tension caused by the horizontal offset of the platform in response to the marine environment. This type of riser is referred to as a freestanding riser.

Hydro-pneumatic tensioner systems are another example of a riser tensioning mechanism used to support risers. A plurality of active hydraulic cylinders with pneumatic accumulators is connected between the platform and the riser to provide and maintain the necessary riser tension. Platform responses to environmental conditions that cause changes in riser length relative to the platform are compensated by the tensioning cylinders adjusting for the movement.

With some floating platforms, the pressure control equipment, such as the blow-out preventer, is dry because it is installed at the surface rather than subsea. However, jurisdiction regulations and other industry practices may require two barriers between the fluids in the wellbore and the sea, a so-called dual barrier requirement. With the production control equipment located at the surface, another system for accomplishing dual barrier protection is needed.

BRIEF DESCRIPTION OF THE DRAWINGS

For a detailed description of the preferred embodiments of the invention, reference will now be made to the accompanying drawings in which.

DETAILED DESCRIPTION

Figure 1:
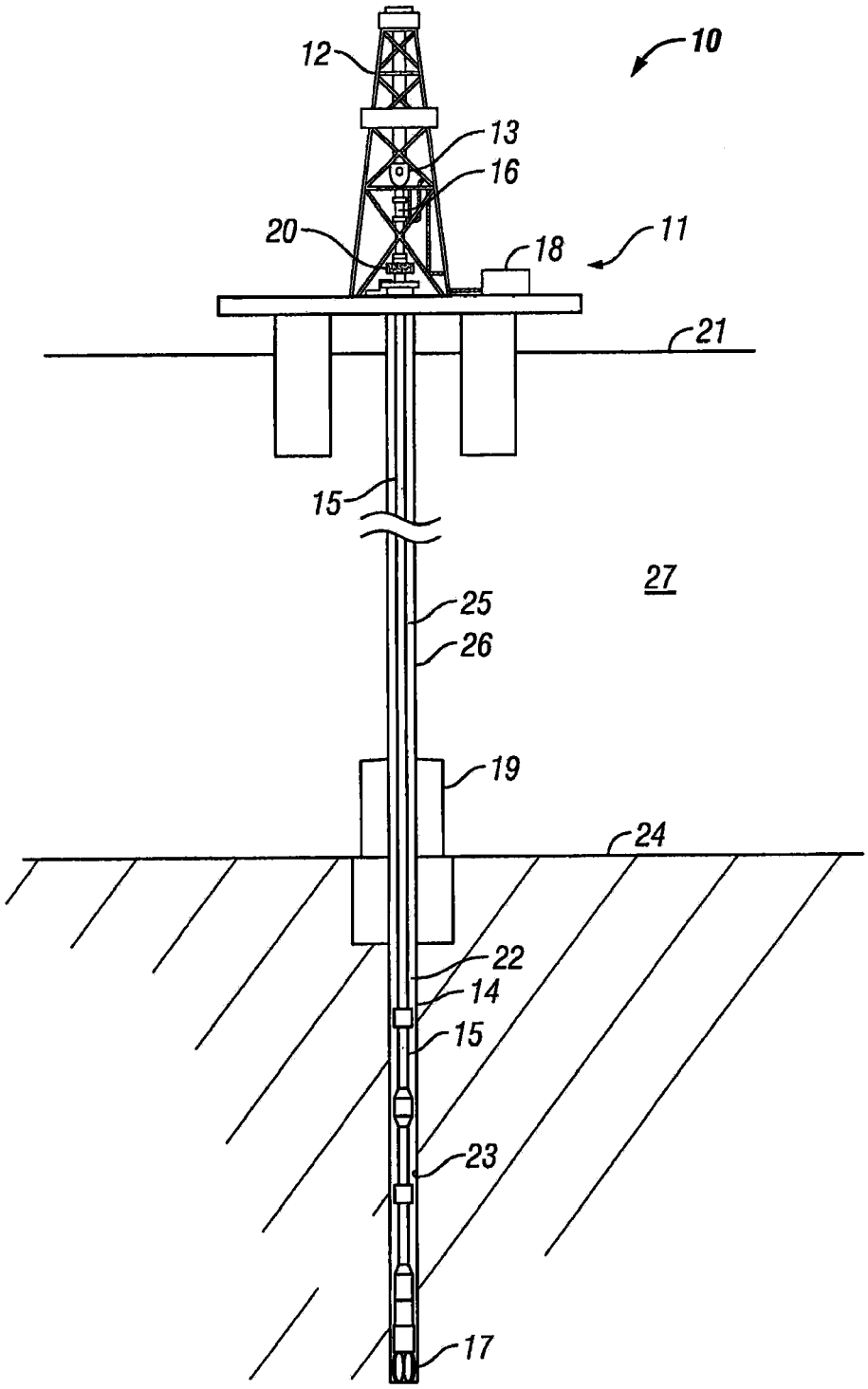
FIG. 1 shows an off-shore sea-based drilling system in accordance with various embodiments.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a schematic view of an offshore drilling system 10 is shown. The drilling system 10 is a dry BOP system and includes a floating platform 11 equipped with a drilling module 12 that supports a hoist 12. Drilling of oil and gas wells is carried out by a string of drill pipes connected together by tool joints 14 so as to form a drill string 15 extending subsea from platform 11. The hoist 12 suspends a kelly 16 used to lower the drill string 15. Connected to the lower end of the drill string 15 is a drill bit 17. The bit 17 is rotated by rotating the drill string 15 and/or a downhole motor (e.g., downhole mud motor). Drilling fluid, also referred to as drilling mud, is pumped by mud recirculation equipment 18 (e.g., mud pumps, shakers, etc.) disposed on the platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through subsea wellhead 19 at the sea floor 24, and up an annulus 25 between the drill string 15 and a riser system 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations. Pressure control equipment such as blow-out preventer ("BOP") 20 is located on the floating platform 11 and connected to the riser system 26, making the system a dry BOP system because there is no subsea BOP located at the subsea wellhead 19.

Figure 2:
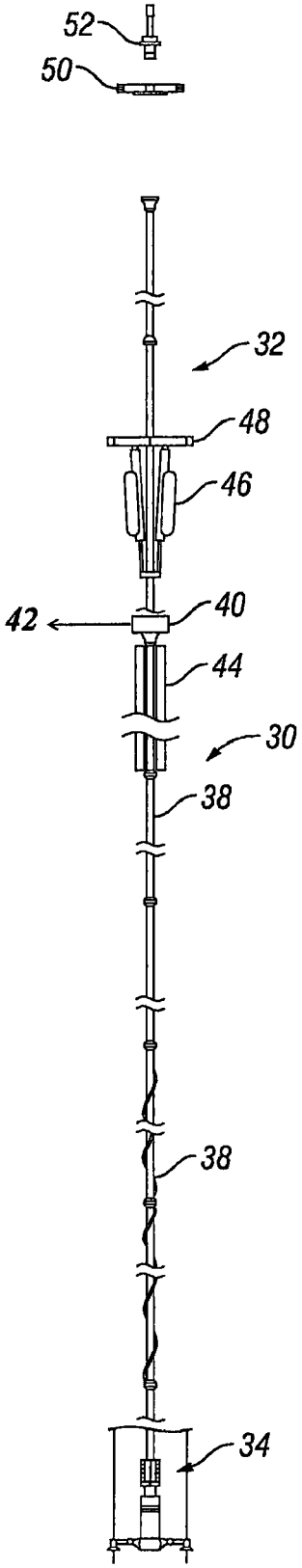
FIG. 2 shows a riser system including an outer riser with a nested internal riser.

As shown in FIG. 2, with the pressure control equipment at the platform 11, the dual barrier requirement may be met by the riser system 26 including a freestanding external riser 30 with a nested internal riser 32. As shown, the external riser 30 surrounds at least a portion of the internal riser 32. The riser system 26 is shown broken up to be able to include detail on specific sections but it should be appreciated that the riser system 26 maintains fluid integrity from the subsea wellhead 19 to the platform 11.

A nested riser system requires both the external riser 30 and the internal riser 32 to be held in tension to prevent buckling. Complications may occur in high temperature, deep water environments because different thermal expansion is realized by the external riser 30 and the internal riser 32 due to different temperature exposures—higher temperature drilling fluid versus seawater. To accommodate different tensioning requirements, independent tension devices are provided to tension the external riser 30 and the internal riser 32 at least somewhat or completely independently.

In this embodiment, the external riser 30 is attached at its lower end to the subsea wellhead 19 (shown in FIG. 1) using an appropriate connection. For example, the external riser 30 may include a wellhead connector 34 with an integral stress joint as shown. As an example, the wellhead connector 34 may be an external tie back connector. Alternatively, the stress joint may be separate from the wellhead connector 34. The external riser 30 may or may not include other specific riser joints, such as riser joints 36 with strakes or fairings and splash zone joints 38. The upper end of the external riser 30 terminates in a diverter 40 that directs fluid to a solids management system of the drilling module 12 as indicated by the arrow 42 for recirculation into the drilling system.

Also included on the external riser 30 is a tension device 44 in the form of at least one buoyancy system that provides tension on the external riser 30 independent of the platform 11. The external riser tension device 44 may be any suitable configuration for providing buoyancy such as air cans, balloons, or foam sections, or any combination of these configurations. The external riser tension device 44 may also be located at another location along the external riser 30 than shown in FIG. 2. The external riser tension device 44 may also be located along or at more than one location along the external riser 30. The external riser tension device 44 provides the external riser 30 with its own tension and thus enables the external riser 30 to be a freestanding riser.

In this embodiment, the internal riser 32 is nested within the external riser 30 and is attached at its lower end to the subsea wellhead 19 (FIG. 1) or to a casing or casing hanger landed in the subsea wellhead 19 using an appropriate connection. For example, the internal riser 32 may stab into a connection in the wellhead 19 with or without rotating to lock in place. The internal riser 32 may also connect inside the external tieback connector 34. The internal riser 32 extends to the platform 11 within the external riser 30, forming an annulus between the external riser 30 and the internal riser 32. The internal riser 32 extends past the upper end of the external riser 30 to the platform 11. On the platform 11, the pressure control equipment (not shown in FIG. 2) is connected to the top of the internal riser 32 to provide well pressure integrity. An internal riser tension device 46 is attached to the internal riser 32 at the portion of the internal riser 32 extending from the upper end of the external riser 30. The internal riser tension device 46 is supported on a tensioner deck 48 of the platform 11 and dynamically tensions the internal riser 32. This allows the tension device 46 to adjust for the movement of the platform 11 while maintaining the internal riser 32 under proper tension. The internal riser tension device 46 may be any appropriate system, such as a hydro-pneumatic tensioner system as shown.

Other appropriate equipment for installation or removal of the external riser 30 and the internal riser 32, such as a riser running tool 50 and spider 52 may also be located on the platform 11.

The riser system 26 is installed by first running the internal riser 32 and locking its lower end in place. Then, the external riser 30 is installed surrounding the internal riser 32. In use, the internal riser 32 provides a return path to the platform 11 for the drilling fluid. Typically, the external riser 30 is filled with seawater unless drilling or other fluids enter the external riser 30.

In this embodiment, when installed, the internal riser 32 is free to move within the external riser 30 and is tensioned completely independently of the external riser 30. Alternatively, the internal riser 32 may be placed in tension and locked to the external riser 30 such that the external riser tension device 44 supports some of the needed tension for the internal riser 32. Also alternatively, the external riser 30 may be tensioned and then locked to the internal riser 32 such that the internal riser tension device 46 supports at least some of the needed tension for the external riser 30.

Although the present invention has been described with respect to specific details, it is not intended that such details should be regarded as limitations on the scope of the invention, except to the extent that they are included in the accompanying claims.

What is claimed is:

1. An offshore well drilling system for drilling a subsea well, including:

a floating platform;

an external riser extending from the subsea well;

an internal riser nested within the external riser and extending from the subsea well to the platform;

an external riser tension device configured to apply tension to the external riser such that the external riser is supported independent of the platform; and an internal riser tension device, separate from the external riser tension device, configured to apply tension to the internal riser.

2. The system of claim 1, further including well pressure control equipment located on the platform and connected with the internal riser, the well pressure control equipment being the only well pressure control equipment for the well.

3. The system of claim 1, wherein the internal riser is free to move within the external riser.

4. The system of claim 1, further including the internal riser tension device to tension the internal riser independently of the external riser.

5. The system of claim 1, further including the external riser tension device to tension the external riser independently of the internal riser.

6. The system of claim 1, further including the internal riser connectable with the external riser such that the external riser is capable of applying tension to the internal riser in tension.

7. The system of claim 1, further including the external riser connectable with the internal riser such that the internal riser is capable of applying tension to the external riser.

8. The system of claim 1, further including the internal riser tension device to place the internal riser in tension dynamically.

9. The system of claim 1, further including the external riser tension device including at least one of an air can, balloon, and foam.

10. The system of claim 1, wherein the internal riser extends from an upper end of the external riser when installed.

11. The system of claim 1, wherein only a portion of the internal riser is nested within the external riser.

12. The system of claim 1, wherein the internal riser tension device is configured to apply tension to the external riser.

13. An offshore well drilling system for drilling a subsea well, including:

a floating platform;

a subsea wellhead;

an external riser extending from the subsea wellhead;

an internal riser nested within the external riser and extending from the subsea wellhead to the platform;

an external riser tension device configured to place the external riser in tension such that the external riser is supported independent of the platform;

an internal riser tension device, separate from the external riser tension device, configured to dynamically place the internal riser in tension; and well pressure control equipment located on the platform and connected with the internal riser, the well pressure control equipment being the only well pressure control equipment for the well.

14. The system of claim 13, wherein the internal riser is free to move within the external riser.

15. The system of claim 13, further including the internal riser tension device to tension the internal riser independently of the external riser.

16. The system of claim 13, further including the external riser tension device to tension the external riser independently of the internal riser.

17. The system of claim 13, further including the internal riser connectable with the external riser such that the external riser is capable of applying tension to the internal riser in tension.

18. The system of claim 13, further including the external riser connectable with the internal riser such that the internal riser is capable of applying tension to the external riser.

19. The system of claim 13, further including the external riser tension device including at least one of an air can, balloon, and foam.

20. The system of claim 13, wherein the internal riser extends from an upper end of the external riser when installed.

21. The system of claim 13, wherein only a portion of the internal riser is nested within the external riser.

* * * * *